US005711031A

United States Patent [19]

Clement

[11] Patent Number: 5,711,031

[45] Date of Patent: Jan. 27, 1998

[54] GUSSETED WADER

[75] Inventor: Norma Clement, Louisville, Ky.

[73] Assignee: LaCrosse Footwear, Inc., LaCrosse, Wis.

[21] Appl. No.: 757,641

[22] Filed: Dec. 2, 1996

Related U.S. Application Data

[63] Continuation-in-part of Ser. No. 635,625, Apr. 22, 1996, abandoned.

[51] Int. Cl.[6] ..... A41D 13/00

[52] U.S. Cl. ..... 2/82; 2/2.15

[58] Field of Search ..... 2/69, 82, 2, 1, 2/79, 80, 227, 228, 236, 220, 221, 237, 81, 2.15, 275, 216–217

[56] References Cited

U.S. PATENT DOCUMENTS

| | | | |
|---|---|---|---|
| 518,369 | 4/1894 | Leavitt | 2/237 |
| 2,348,793 | 5/1944 | Deybberg . | |
| 4,843,641 | 7/1989 | Cusick et al. . | |
| 4,912,860 | 4/1990 | Keller . | |
| 5,033,124 | 7/1991 | Bucalo et al. . | |
| 5,033,125 | 7/1991 | de la Villefrommoy et al. . | |
| 5,144,697 | 9/1992 | Sandbeck | 2/79 |

OTHER PUBLICATIONS

Cabela's 1994 Annual Fall Catalog, p. 126, Item B and p. 15, Coveralls.

*Primary Examiner*—Gloria Hale
*Attorney, Agent, or Firm*—Foley & Lardner

[57] ABSTRACT

A wader for use in fishing, and other activities in which a person wades through water, is provided with gussets on opposed sides in an upper portion of the wader. The gussets are foldable and a VELCRO strip, or a belt or the like, is utilized to maintain the gussets in a foldable condition thereby providing for a wader for use by wearers of different girth sizes.

18 Claims, 2 Drawing Sheets

FIG. 1
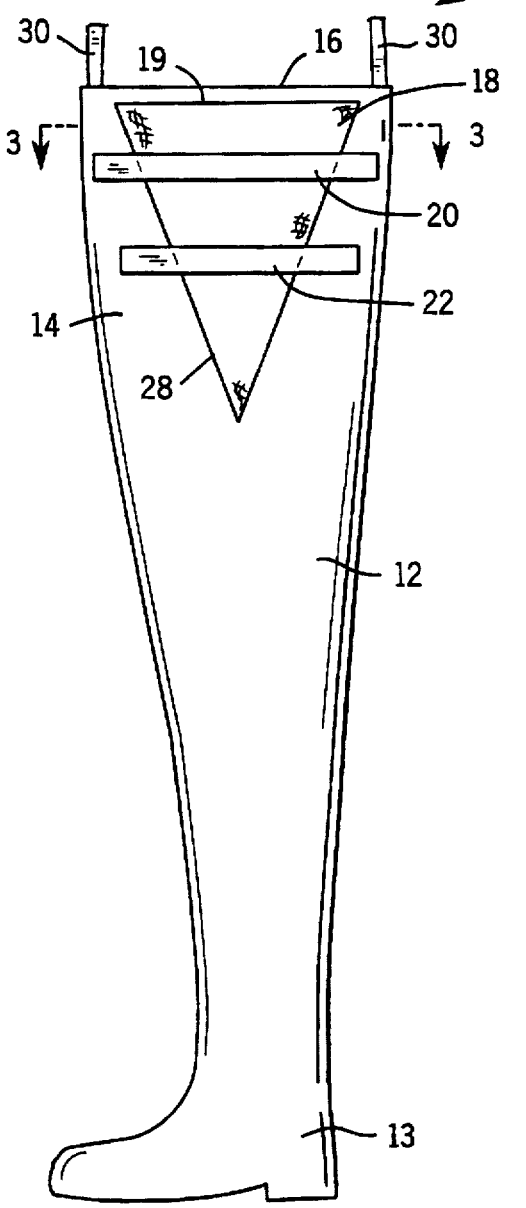
FIG. 2
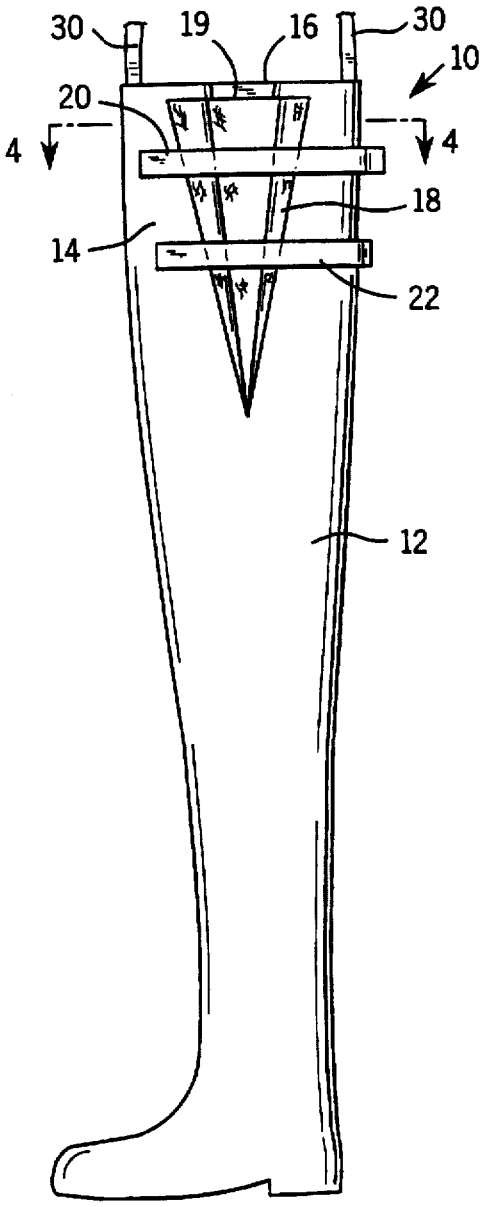
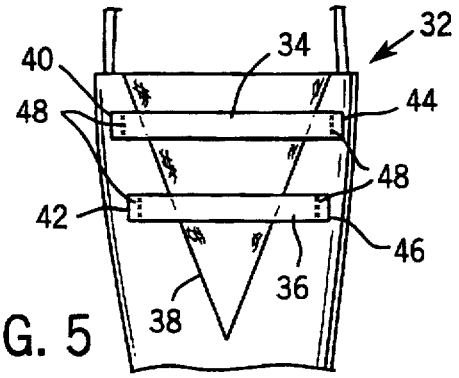
FIG. 5
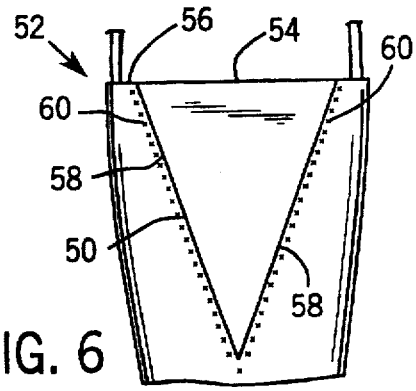
FIG. 6

GUSSETED WADER

This application is a continuation-in-part of U.S. Ser. No. 08/635,625, filed Apr. 22, 1996, now abandoned.

BACKGROUND OF THE INVENTION

This invention relates to protective, water resistant clothing known as waders and particularly water resistant waders useful to fit wearers of different girth sizes.

The use of protective, water resistant clothing, particularly known as "waders" are utilized in water sports, such as fishing, where the wearer enters the water. These waders are particularly useful in instances where the water is in a relatively cold environment. These waders are generally of one piece construction with boots being integral therewith and the waders extend up to the hip or waist of the wearer. Moreover, there are waders which extend upwards around the torso to the arm pits of the wearer and these waders are typically supported by shoulder straps or the like.

Waders that extend around the torso of a wearer and particularly extend up to the arm pits are commercially available with different sized boots on the bottom and different girths for that part of the wader that goes around the torso. Thus, manufacturers of these waders have to manufacture different size boots for each given girth measurement for which the waders are to be sold.

SUMMARY OF THE INVENTION

It is an object of the present invention to provide a wader which extends around the torso with means to adjust the girth size for wearers having different girth sizes.

It is another object of the present invention to provide a wader of the chest high type with gussets on opposite sides of the wader which are foldable thereby providing the means to take up the girth of the wader.

More particularly, the present invention provides a gusseted wader comprising: a lower portion comprising a waist high wader of a water proof material; an upper portion co-extensive with said lower portion and extending upwards covering a chest area of a user, the upper portion having first and second side panels of a fabric material disposed on opposite sides of the wader; and, first and second adjustable fastening means on opposite sides of the wader, the fastening means being in cooperating relation with the side panels whereby adjusting the fastening means defines the width of the side panels.

Further objects and features of the present invention will become apparent from the following description of the preferred embodiment of the present invention with reference to the accompanying drawings.

BRIEF DESCRIPTION OF THE DRAWINGS

FIG. 1 is a side view of one preferred gusseted wader of the present invention;

FIG. 2 is a sectional view of the gusseted wader taken along lines 2—2 of FIG. 1;

FIG. 5 is a side view of an upper portion of a second preferred gusseted wader of the present invention; and FIG. 6 is a side view of an upper portion of a third preferred gusseted wader of the present invention.

DESCRIPTION OF THE PREFERRED EMBODIMENT

Figure 3:
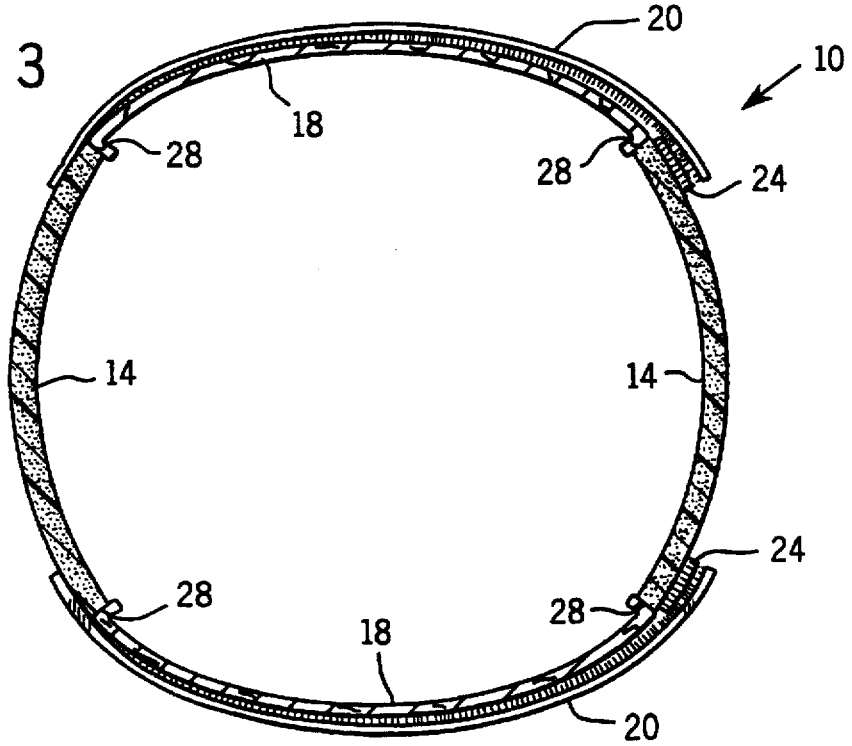
FIG. 3 is a side view of the gusseted wader of FIG. 1 with the gussets in a taken-up condition.

As shown in the Figures, a wader 10 which extends to the chest or arm pit of a user includes a lower portion 12 which extends substantially to the waist area of a user and an upper portion 14 which is co-extensive with the lower portion 12 and extends up beyond the chest or to the arm pit area of a user. Lower portion 12 includes foot or boot area 13 for receiving feet therein, only one foot being shown in FIGS. 1 and 3. Generally, the foot portion 13 is made either to accommodate the feet of the user or alternatively may be configured so as to fit a pair of boots. Moreover, wader 10 is generally constructed of a durable water proof or water proofable material such as a foam neoprene or a nylon-lined or spandex-lined foam neoprene. Linings may also be placed on the outside of the wader to increase durability.

In the upper portion 14 of the wader 10 a triangular section of the one-piece wader has been replaced with a thinner fabric material 18, which may be any type of water proof fabric material utilized in waders, such as cotton, neoprene, nylon, polyester, and the like, which are easily foldable. The triangular-shaped gussets 18 are provided with a base portion 19 adjacent upper edge 16 of the upper portion 14.

Figure 4:
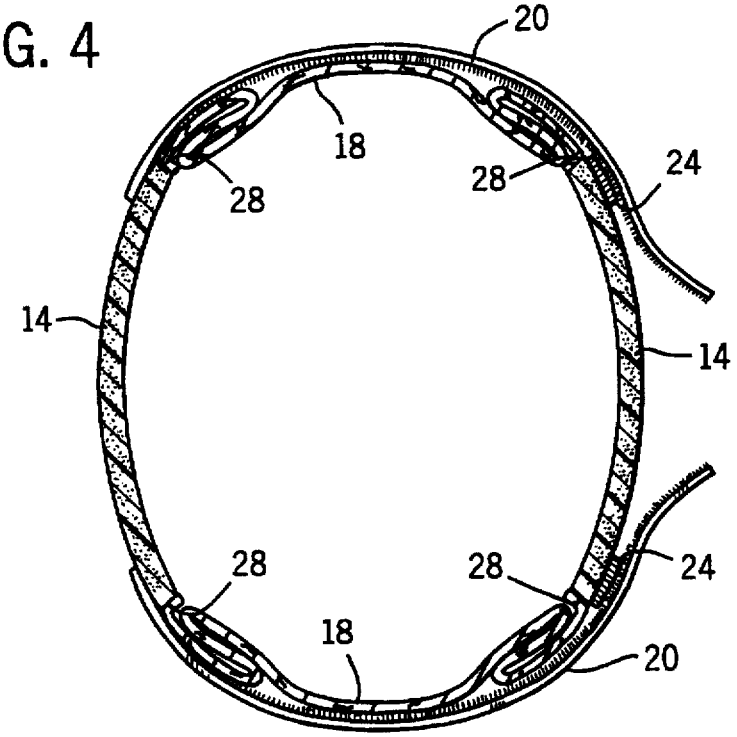
FIG. 4 is a sectional view of the gusseted wader taken along lines 4—4 of FIG. 3

As shown in FIG. 1, gusset 10 is shown in its extended or widest width. In this position, as best shown in FIG. 2, with the gussets 18 on opposite sides of the wader in their extended most position, the wader 10 may accommodate a person of a relatively large girth. As shown in FIGS. 3 and 4, the gussets 18 have been folded or taken up so that the girth of the wader is lessened to accommodate a wearer having a smaller girth than one who would wear the wader 18, as shown in its extended position in FIGS. 1 and 2.

As shown in FIGS. 2 and 4, the gussets 18 are thinner than the rest of the upper portion 14 which is made of a water proof material, such as a foam neoprene or the like, and are also more flexible so the gussets may be folded easily for taking up the girth of the wader 10.

A pair of adjustable fastening means shown as hook and loop fastener (VELCRO strips) 20 and 22 in FIGS. 1 and 3, are utilized to take up the gussets 18 when the girth of the wader 10 is to be reduced. Nylon webbing with an adjustable buckle (not shown) may also be used. The VELCRO strips 20 and 22 are provided in mating relations with VELCRO tabs, only VELCRO tab 24 for VELCRO strip 20 being shown in FIGS. 2 and 4. The strips 20 and 22 in mating relation with their cooperating tabs provide the adjustable fastening means for taking up the gussets 18. It is realized that even though only VELCRO strips and tabs are shown as the adjustable fastening means, belts or other well known adjusting means may be utilized for adjustably fastening or taking up the gussets 18. Shoulder straps 30 are also provided for strapping the wader 10 to a wearer.

Gussets 18 are attached to the upper portion 14 by, for example, sewing the fabric gusset 18 on the lines identified by the numeral 28 to foam neoprene, or the like, water proof material. Thus, with the gussets 18 being made of an easily foldable fabric material which provides the means for taking up the girth of the wader, one gusseted wader will accommodate wearers having different girth sizes.

Referring now to FIG. 5, an alternative means for taking up the girth of a wader 32 is shown. In particular, the releasible VELCRO strips and tabs of wader 10 (see FIGS. 1–4) have been replaced with elastic bands 34, 36 on wader 32. Each elastic band 34, 36 extends laterally across a width of a gusset 38 with one end 40, 42, respectively, attached along one side of gusset 38 and an opposite end 44, 46, respectively, attached along an opposite side of gusset 38. Bands 34, 36 may be attached to wader 32 by conventional means such as by stitching 48. Alternatively, each elastic band could be attached at one end thereof with an adjustable buckle (not shown) or by cooperating hook and loop fastener elements similar to that illustrated in the embodiment of FIGS. 1–4. In this case, the primary adjustment would be by way of the buckle or releasible fastener, and the elastic material would allow increased freedom of movement for the wearer. Referring again to FIG. 5, gusset 38 is thinner and more flexible than the rest of wader 32 and is preferably made from a water proof material. Bands 34, 36 have a length in a relaxed state which is less than the width of gusset 38 for taking up gusset 38 when wader 32 is worn by a wearer having a girth less than maximum. Bands 34, 36 will then preferably stretch up to the width of gusset 38 to accommodate wearers having a maximum girth size. A similar gusset and elastic band arrangement is provided on the opposite side of wader 32.

Turning now to FIG. 6, the straps and bands previously described for taking up the gussets to adjust the girth of a wader have been eliminated entirely. Instead, a pair of gussets 50 on opposite sides of a wader 52 are provided which are themselves made of an elastic material, and thus the gussets are self-gathering. The elastic material of gussets 50 is thinner and more flexible than the remainder of the material of wader 52, and preferably water proof. Gussets 50 are preferably triangular shaped panels having a base portion 54 adjacent an upper edge 56 of wader 52. Gussets 50 may be secured along the remaining two edges 58 to wader 52 by conventional means such as by stitching 60.

While preferred embodiments of the present invention have been described in detail as referenced to the attached drawings, it is understood that various modifications and changes may be made in the gusseted wader without departing from the spirit and scope of the appended claims.

What is claimed is:

1. A wader comprising:

a lower portion comprising a waist-high wader of a water proof material;

an upper portion of a first elastic waterproof material having a first flexibility co-extensive with said lower portion and extending upwards covering a chest area of a user, said upper portion having first and second side panels of a second waterproof material having a second greater flexibility disposed on opposite sides of said wader and extending above an abdomen of the user; and first and second adjustable fastening means on opposite sides of said wader, said fastening means being in cooperating relation with said side panels whereby adjusting said fastening means defines the width of said side panels.

2. The wader of claim 1, said fastening means being a strip with one end attached along one side of a side panel and a second end detachably attached along an opposite side of a side panel, said second end being length adjustable.

3. The wader of claim 2, said fastening means being a hook and loop fasteners.

4. The wader of claim 1, said second material being an easily foldable material.

5. The wader of claim 1, said second material being thinner in thickness than said first water proof material.

6. The wader of claim 1 wherein said side panels are of a triangular shape with a base portion of the triangle being adjacent an upper edge of said upper portion.

7. A wader comprising:

a lower portion comprising a waist-high wader of a water proof material;

an upper portion of a first elastic waterproof material having a first flexibility co-extensive with said lower portion and extending upwards covering a chest area of a user, said upper portion having first and second side panels of a second elastic waterproof material having a second greater flexibility disposed on opposite sides of said wader and extending above an abdomen of the user; and, first and second means on opposite sides of said wader for gathering in the fabric material.

8. The wader of claim 7, said gathering means being an elastic band with a first end attached along one side of a side panel and a second end attached along an opposite side of the side panel.

9. The wader of claim 8, the first and second ends of said elastic band being attached along sides of the side panel by stitching.

10. The wader of claim 8, said elastic band extending laterally across a width of the side panel and having a length when in a relaxed state which is less than the width of the side panel.

11. The wader of claim 7, said second material being an easily foldable material.

12. The wader of claim 7, said second material being thinner in thickness than said first water proof material.

13. The wader of claim 7, wherein said side panels are of a triangular shape with a base portion of the triangle being adjacent an upper edge of said upper portion.

14. A wader comprising:

a lower portion comprising a waist-high wader of an elastic water proof material; and an upper portion of a first elastic waterproof material having a first flexibility co-extensive with said lower portion and extending upwards covering a chest area of a user, said upper portion having first and second side panels of a second elastic waterproof material having a second greater flexibility disposed on opposite sides of said wader, said elastic panels extending from an upper edge of said upper portion above an abdomen of the user toward said lower portion.

15. The wader of claim 14, said second elastic material being thinner in thickness than said first water proof material.

16. The wader of claim 14, wherein the side panels are of a triangular shape with a base portion of the triangle being adjacent the upper edge of said upper portion.

17. The wader of claim 7 including shoulder straps.

18. The wader of claim 14 including shoulder straps.

* * * * *